United States Patent [19]

Falcone

[11] Patent Number: 4,761,972

[45] Date of Patent: Aug. 9, 1988

[54] JEWELRY ORNAMENT

[76] Inventor: Thomas L. Falcone, 15 Wolfe St., Providence, R.I. 02909

[21] Appl. No.: 55,175

[22] Filed: May 28, 1987

[51] Int. Cl.[4] ..... A44C 15/00

[52] U.S. Cl. ..... 63/20; 40/620; 29/160.6

[58] Field of Search ..... 63/29 R, 29 M, 12, 14 R, 63/20, 2; 40/622, 618, 620; 24/631, 630; 29/160.6

[56] References Cited

U.S. PATENT DOCUMENTS

| | | | |
|---|---|---|---|
| 2,178,055 | 10/1939 | Stupell | 40/618 |
| 2,205,908 | 6/1940 | Placco | 40/620 |
| 2,209,714 | 7/1940 | Chernow | 40/618 |
| 2,584,185 | 2/1952 | Cheney | 63/2 X |
| 3,529,373 | 9/1970 | Aaskov | 63/29 R |
| 3,853,416 | 12/1974 | Hanan | 63/12 |
| 3,913,184 | 10/1975 | Hanan | 63/29 R |

*Primary Examiner*—Richard J. Johnson

*Attorney, Agent, or Firm*—Barlow & Barlow, Ltd.

[57] ABSTRACT

A jewelry article for attaching ornaments has a mounting bar with a plurality of apertures, and each ornament has a protruberance extending rearwardly therefrom. The protruberance has a neck portion located thereon a distance remote from the ornament substantially equal to the thickness dimension of the bar and the bar is provided with a single spring wire extending across each aperture and held thereon for minimum deflection so that when an ornament is pressed into place, the spring wire wil firmly engage the neck portion and hold the ornament in place.

1 Claim, 1 Drawing Sheet

JEWELRY ORNAMENT

BACKGROUND OF THE INVENTION

This invention relates to Initial Jewelry such as a broach or the like in which an initial or other ornament is carried by a suitable mounting piece.

In the past, it has been relatively common to press initials into mounting bars by the use of tools. For example, in the Stupell Patent, U.S. Pat. No. 2,178,055, a bar like member which is used to mount the initials is resiliant and the initials or other ornaments carry suitable projections that, due to their shape, create a wedge action or a cam action to deform the bar. There also has been suggested by the prior art the utilization of a spring means which was placed around an aperture so as to grip the initial or ornament as, for example, in the Cheney Patent, U.S. Pat. No. 2,584,185. The latter disclosure solves the pressing problem of having a retailer assemble the initials onto a bar but has the disadvantage of utilizing a spring which has to be held in position by a cover piece. The structure is relatively expensive in this form.

SUMMARY OF THE INVENTION

One of the principal objects of the invention is to overcome some of the problems that have existed and to provide an extremely simple arrangement for mounting an ornament upon a jewelry object so that the same may be individualized and, more particularly, by the utilization of initials. In accomplishing this, there is provided a bar that has a plurality of square apertures therein and the bar may have some suitable means for utilizing the jewelry article as, for example, a pin stem may be mounted thereon together with a pin stem catch. Mounted across the edge of the apertures is a stiff wire in the form of a spring wire while each of the ornaments or initials is provided with a rearwardly projecting protuberance of the same shape as the aperture. Each of the protuberances has a neck located thereon at a distance remote from the initial substantially equal to the thickness of the bar.

DESCRIPTION OF THE PREFERRED EMBODIMENT

Figure 3:
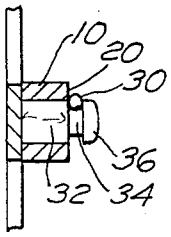
FIG. 3 is a section taken on lines 3—3 of FIG. 2.
Figure 4:
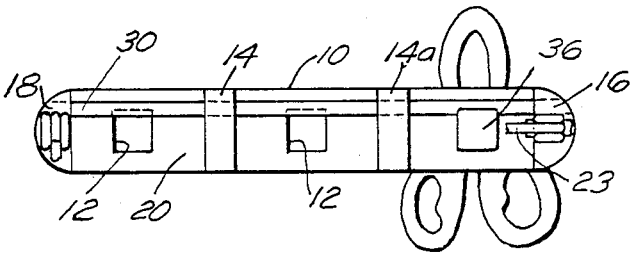
FIG. 4 is a rear elevational view, in slightly enlarged form illustrating one initial in place.

In proceeding with the invention, I provide a bar 10 of substantial thickness such as illustrated in FIG. 3 and into this bar a plurality of apertures 12 are formed which apertures are ideally square in configuration. The bar has a substantial thickness thereto as seen more particularly in FIG. 3 and on the reverse face thereof (see FIG. 4) there is provided ridges 14, 14*a* and integral end mounts 16, 18, all rising from the rear face 20. For example, on the portion 16, a pin stem finding 22 with pin stem 23 may be fixed while, on the portion 18, a catch 24 is fixed.

Figure 1:
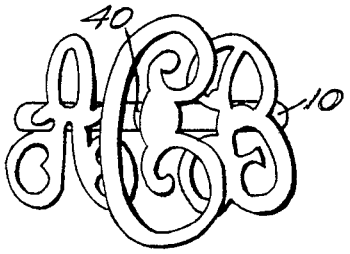
FIG. 1 is a front elevational view of a completed broach embodying the invention.
Figure 2:
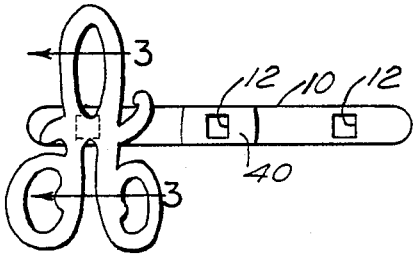
FIG. 2 is a elevational view one initial mounted on the bar.
Figure 6:
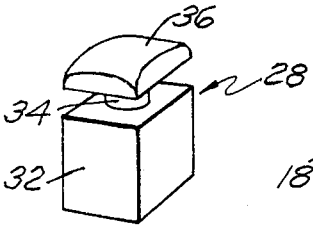
FIG. 6 is a perspective view illustrating the protruberance that is affixed to the initial or other ornament.
Figure 5:
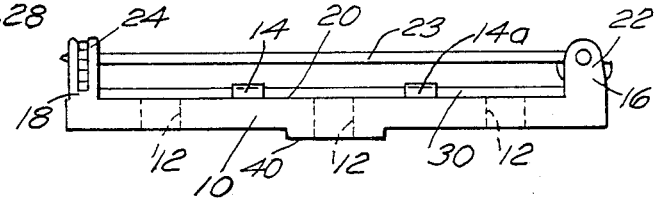
FIG. 5 is a side elevational view illustrating the bar of the invention.

A spring 30 is anchored in each of the raised portions 14, 14*a*, 16, and 18 and is oriented in such a fashion as to have at least one half of the width thereof extending over the edge of the apertures 12. Due to the fact that there are a number of raised portions that anchor the spring member, there is very little deflection that can be achieved in a lateral bending momemt. Deflection, however, of the spring may be achieved by the protruberances generally designated 28 which are pressed into the apertures 12. As seen in FIG. 6, these protruberances may be formed essentially as a square section 32, a reduced neck 34, and a chamfered head 36. The dimension of the square section 32 is made preferably equal or substantially equal to the thickness of the bar 10. In this fashion, as seen in FIG. 3, the protruberance which is fastened onto the rear face of the ornament or initial may be passed thru one of the apertures or openings 12 and the nose section 36 will cause a portion of the spring 30 to deflect sufficiently so that it may pass over the chamfered head and into the neck portion 34. This then prevents the protruberance from moving out of the aperture 12 and the ornament and initial become firmly anchored to the bar. By reason of the fact that the protruberance is of square shape, the ornament or initial cannot rotate and is held firmly in position. It will also be noted that the bar 10 is illustrated as having a thick central portion 40. This construction allows the central initial to protrude over the two end initials and produce a pleasing design as seen in FIG. 1.

I claim:

1. A jewelry article or the like for the attachment of ornaments comprising a bar that defines two opposite faces and has a plurality of square apertures therethrough, each aperture having a raised portion adjacent thereto, said bar having a pin stem mounted on one face, an elongated continuous spring wire fastened on said one face, and held in each raised portion to restrict deflection thereof, said wire extending across each aperture adjacent one edge thereof, ornaments having a square protruberance extending normal to the ornament, each protruberance having a neck located thereon a distance remote from the ornament substantially equal to the thickness of the bar, said spring wire engaging the neck portion to hold the ornament.

* * * * *